US012765701B2

(12) United States Patent
Grabher et al.

(10) Patent No.: US 12,765,701 B2
(45) Date of Patent: Oct. 20, 2026

(54) CONTAINER HEAD

(71) Applicant: René Grabher, Lustenau (AT)

(72) Inventors: René Grabher, Lustenau (AT); Adis Causevic, Berneck (CH)

(73) Assignee: René Grabher, Lustenau (AT)

( * ) Notice: Subject to any disclaimer, the term of this patent is extended or adjusted under 35 U.S.C. 154(b) by 36 days.

(21) Appl. No.: 19/107,745

(22) PCT Filed: Sep. 29, 2022

(86) PCT No.: PCT/AT2022/000012
§ 371 (c)(1),
(2) Date: Feb. 28, 2025

(87) PCT Pub. No.: WO2024/064978
PCT Pub. Date: Apr. 4, 2024

(65) Prior Publication Data

US 2026/0069066 A1 Mar. 12, 2026

(51) Int. Cl.

| | |
|---|---|
| ***A47G 19/22*** | (2006.01) |
| ***B65D 47/12*** | (2006.01) |
| ***B65D 47/20*** | (2006.01) |
| ***B65D 47/32*** | (2006.01) |
| ***B65D 77/04*** | (2006.01) |

(52) U.S. Cl.
CPC ..... *A47G 19/2272* (2013.01); *B65D 47/122* (2013.01); *B65D 47/20* (2013.01); *B65D 47/32* (2013.01); *B65D 77/0493* (2013.01)

(58) Field of Classification Search
CPC .. A47G 19/2272; B65D 47/122; B65D 47/20; B65D 47/32; B65D 77/0493; B65D 47/06; B65D 81/3227
See application file for complete search history.

(56) References Cited

U.S. PATENT DOCUMENTS

| | | | | |
|---|---|---|---|---|
| 5,076,470 A | | 12/1991 | Hatakeyama et al. | |
| 5,353,964 A | | 10/1994 | Liu et al. | |
| 6,126,679 A | * | 10/2000 | Botts | A61J 7/0053 215/11.1 |

(Continued)

FOREIGN PATENT DOCUMENTS

| | | |
|---|---|---|
| CN | 2340698 Y | 9/1999 |
| CN | 101016108 A | 8/2007 |

(Continued)

*Primary Examiner* — Bob Zadeh
(74) *Attorney, Agent, or Firm* — Volpe Koenig

(57) ABSTRACT

A container head with a mouthpiece, longitudinally elongate in a longitudinal extent direction, and a main body. The main body has a first connector for a first container and a second connector for a second container, and the mouthpiece is fastened in the main body in an operating position. A first liquid line for transporting a first drinkable liquid in the operating position leads from the first connector through the interior of the mouthpiece to a first outlet opening in the mouthpiece, and a second liquid line for transporting a second drinkable liquid in the operating position leads from the second connector through the interior of the mouthpiece to a second outlet opening in the mouthpiece. The first outlet opening is arranged further away from an end of the mouthpiece which lies opposite the main body in the operating position than the second outlet opening.

19 Claims, 4 Drawing Sheets

(56) References Cited

U.S. PATENT DOCUMENTS

| | | | | |
|---|---|---|---|---|
| 8,690,015 | B2 * | 4/2014 | Mainville | B65D 47/06 222/481.5 |
| 11,377,250 | B2 | 7/2022 | Le Reverend et al. | |
| 2007/0075081 | A1 | 4/2007 | Stokes | |
| 2008/0223807 | A1 * | 9/2008 | Botts | A61J 7/0046 215/11.1 |
| 2009/0134110 | A1 * | 5/2009 | Jones | B65D 81/3227 215/6 |
| 2020/0130884 | A1 | 4/2020 | Le Reverend et al. | |
| 2026/0069066 | A1 * | 3/2026 | Grabher | A47G 19/2272 |

FOREIGN PATENT DOCUMENTS

| | | | | | |
|---|---|---|---|---|---|
| CN | 203372567 | U | | 1/2014 | |
| CN | 104369971 | A | | 2/2015 | |
| CN | 204776592 | U | | 11/2015 | |
| CN | 107098028 | A | | 8/2017 | |
| CN | 207120975 | U | | 3/2018 | |
| CN | 109229935 | A | * | 1/2019 | B65D 81/3227 |
| DE | 102009020435 | B4 | | 11/2011 | |
| DE | 202016004961 | U1 | | 9/2016 | |
| DE | 202018000382 | U1 | | 5/2018 | |
| EP | 0979782 | B1 | | 7/2001 | |
| EP | 2653405 | A1 | | 10/2013 | |
| GB | 2497781 | A | * | 6/2013 | B65D 81/3205 |
| GB | 2525847 | A | | 11/2015 | |
| WO | 2003093130 | A1 | | 11/2003 | |
| WO | 2006055508 | A2 | | 5/2006 | |
| WO | WO-2006055507 | A2 | * | 5/2006 | B65D 81/3216 |
| WO | 2007053970 | A1 | | 5/2007 | |
| WO | 2018234275 | A1 | | 12/2018 | |
| WO | 2019016096 | A1 | | 1/2019 | |
| WO | 2020126210 | A1 | | 6/2020 | |
| WO | 2021144387 | A1 | | 7/2021 | |

* cited by examiner

CONTAINER HEAD

CROSS-REFERENCE TO RELATED APPLICATIONS

This application is the U.S. National Phase of PCT Appln. No. PCT/AT2022/000012, filed Sep. 29, 2022, the entire disclosure of which is incorporated by reference herein.

TECHNICAL FIELD

The present invention relates to a container head, and to a drinking bottle.

BACKGROUND

Nowadays, a large number of beverages are consumed which contain a proportion, unhealthily high in the long term, of calories, in particular sugar, and/or alcohol, and/or other substances which, although rich in taste, are ultimately harmful to health. In order to remedy this problem, it is known to dilute the substances which are admittedly rich in taste or tasty with water or other suitable, drinkable liquids, which also leads precisely, however, to the mixed beverage tasting diluted.

U.S. Pat. No. 5,343,964 A belongs to the prior art and discloses a baby bottle with two containers which lie inside one another and the connecting piece of which has a lever for setting the mixing ratio of the two liquids. During drinking, the two liquids are mixed in the teat of the bottle before they leave the teat.

WO 2018/234275 A1 discloses a drinking bottle with two containers for two drinkable liquids which. during drinking, exit via outlet openings which are arranged directly next to one another.

In the prior art, therefore, either two liquids are mixed with one another before this mixture is drunk, or two liquids are dispensed at spatially directly adjacent outlet openings of a drinking bottle. As a result, the taste buds of the drinker sense the taste of a diluted beverage.

SUMMARY

It is the object of the present invention to provide a container head which allows a first drinkable liquid rich in taste to be mixed with a second drinkable liquid during drinking, without this substantially reducing the taste experience of the drinkable liquid rich in taste for the drinker. With regard to the present invention, this is achieved by a container head having one or more of the features disclosed herein.

It is therefore provided according to the invention in the case of a container head in accordance with the disclosure that the first outlet opening is arranged further away from an end of the mouthpiece which lies opposite the main body in the operating position than the second outlet opening.

By virtue of the fact that the first outlet opening is situated in the longitudinal extent direction closer to the main body and therefore further away from an end of the mouthpiece which lies opposite the main body in the operating position than the second outlet opening, the first drinkable liquid which is preferably the liquid rich in taste can be fed during drinking from the first container via the first outlet opening direct to the taste buds on the tongue, whereas the second drinkable liquid which is preferably used for dilution exits from the second container further to the rear in the mouth, where it influences the taste sensation little or practically not at all. It is thus possible for a first drinkable liquid which is rich in taste but, for example, also high in calories and/or alcohol to be diluted during drinking with a second drinkable liquid, without the drinker having the taste sensation of dilution. For the drinker, the taste sensation corresponds at least substantially to that as if they are drinking the first liquid which is richer in taste in undiluted form.

As a result of this type of distribution of two drinkable liquids in the oral cavity, wherein the first drinkable liquid can contain, for example, more flavorings and/or more sweeteners and/or also more alcohol than the second drinkable liquid, the drinker tastes substantially only the non-diluted first drinkable liquid and at the same time ingests a greater overall quantity of liquid, since the first drinkable liquid is mixed with the second drinkable liquid further to the rear in the mouth and the first drinkable liquid is not diluted until there.

It is therefore a core concept of the invention to configure the container head and, in particular, its mouthpiece in such a way that the first drinkable liquid is conducted directly to the taste buds on the tongue, while the second drinkable liquid is guided past the taste buds of the tongue in a targeted manner.

In the following text, for the purposes of linguistic simplification, the first drinkable liquid is also called only the first liquid, and the second drinkable liquid is also called only the second liquid.

In the case of the mouthpiece which is longitudinally elongated in the longitudinal extent direction, in other words, reference can also be made to a stem-shaped and/or pin-shaped and/or straw-shaped mouthpiece.

The first outlet opening and the second outlet opening are each outlet openings in the mouthpiece which are open toward the outside. In the case of a first outlet opening and a second outlet opening, these two outwardly open outlet openings can be oriented in all directions and/or can have different outlet directions.

Container heads according to the invention can be configured for drinking from two or else more than two containers. For example, in one preferred embodiment, connectors for three or more containers can also be provided, in order for it to be precisely possible for three or more drinkable liquids to be drunk at the same time in the way according to the invention. The connectors of the container head can be configured in such a way that, in the state in which they are connected to the container head, the containers are arranged inside one another and/or also next to one another. In the case of more than two connectors for more than two containers, a corresponding number of outlet openings and liquid lines are then preferably precisely also provided in an analogous manner. The arrangement of the outlet openings relative to one another in the mouthpiece takes place according to the invention. The number of connectors, outlet openings and liquid lines is therefore not limited to in each case two as in the exemplary embodiments described. The containers can be configured as separate bodies. The containers can also, however, be connected to one another in one piece. Reference can then also be made to a multiple-chamber container which comprises at least two containers. The first liquid and the second liquid and also further liquids can each be a single liquid such as, for example, juice or water. These liquids, individually or together, can just as well also be premixed mixtures of liquids.

The connection between the first container and the first connector and/or the connection between the second container and the second connector are/is preferably configured such that they can be released in a non-destructive manner. For example, at least one of these connections can be a plug-in connection and/or clamp connection and/or screw connection which can be released in a non-destructive manner.

The mouthpiece can also be fastened or can be capable of being fastened fixedly but also releasably to the main body. In the operating position, the mouthpiece is in any case fastened to the main body.

Further advantageous embodiments of the invention are defined in the the description and claims that follow.

It can be provided in accordance with one preferred embodiment of the container head that a spacing, preferably measured parallel to the longitudinal extent direction of the mouthpiece, between the first outlet opening and the second outlet opening is at least 3 mm, preferably at least 5 mm, particularly preferably at least 8 mm. This spacing particularly preferably lies in a range from 3 mm to 20 mm or in a range from 5 mm to 20 mm or in a range from 8 mm to 20 mm.

It can be provided in accordance with one preferred embodiment of the container head that the first outlet opening and the second outlet opening are arranged on sides of the mouthpiece which are different than one another and preferably lie opposite one another.

In this way, the first liquid can particularly preferably be dispensed from the mouthpiece downward, preferably directly onto the tongue, while the second liquid leaves the mouthpiece upward, in the direction of the roof of the mouth, and therefore has less or even no contact with the taste buds on the tongue.

It is a further advantage of this arrangement that an upwardly directed outlet opening cannot be closed by the tongue.

It can be provided in accordance with one preferred embodiment of the container head that the mouthpiece has at least one bead, wherein the bead is arranged directly adjacently with respect to the first outlet opening, or is spaced apart from the first outlet opening by a spacing, preferably measured parallel to the longitudinal extent direction of the mouthpiece, of at most two times, preferably at most one time, the height of the bead.

A bead is a region of the mouthpiece which projects beyond the regions of the mouthpiece which are adjacent with respect to the bead.

The height of the bead is preferably measured in a direction orthogonally with respect to the longitudinal extent direction of the mouthpiece, and is a measure for how far the bead projects at most beyond a region of the mouthpiece which is adjacent with respect to the bead.

A bead can but does not necessarily have to be delimited by a rounded surface.

The bead can fulfill two functions. Firstly, the bead can serve as a positioning aid of the mouthpiece within the mouth. The bead can thus be positioned behind the teeth in the mouth, as a result of which the mouthpiece can be positioned correctly within the mouth, and the first outlet opening and the second outlet opening are therefore situated within the mouth. Secondly, the bead can act as a spacer element with respect to the tongue, as a result of which the first outlet opening cannot be closed by the tongue.

It can be provided in accordance with one preferred embodiment of the container head that the bead runs along a peripheral line of the mouthpiece, wherein the peripheral line of the mouthpiece lies in one plane, wherein the longitudinal extent direction of the mouthpiece lies perpendicularly on this plane.

It can preferably be provided that a peripheral line of the mouthpiece, along which the bead runs, is an imaginary peripheral line of the mouthpiece.

Moreover, it can preferably be provided that the bead encloses the mouthpiece completely or runs only over part regions of the periphery of the mouthpiece.

It can be provided in accordance with one preferred embodiment of the container head that the first outlet opening opens into an outwardly open channel in the mouthpiece, wherein the channel runs at least partially along a periphery of the mouthpiece.

During drinking, the first liquid exits from the first outlet opening and can be guided around the mouthpiece more easily with the aid of the channel. In this way, an additional volume of the first liquid can additionally be left in the mouth when the mouthpiece is set down after the drinking operation, as a result of which a pronounced aftertaste is perceived.

It can preferably be provided that the channel runs along the periphery of the mouthpiece up to in each case an angle of 90° starting from the first outlet opening. In other words, this means that the course of the channel can consist of two circular portions, wherein the two circular portions, each starting from the first outlet opening, enclose an angle of 90°, in different directions.

Moreover, it can be provided that the channel runs along a or the peripheral line, wherein the peripheral line lies in one plane, wherein the longitudinal extent direction of the mouthpiece lies perpendicularly on this plane.

The channel can at any rate be used to distribute the first liquid extensively onto the tongue, with the result that as many tastebuds as possible are reached.

It can be provided in accordance with one preferred embodiment of the container head that the first outlet opening extends into a longitudinally elongate reservoir which is configured as an outwardly open groove in the mouthpiece, wherein it is preferably provided that the reservoir is arranged so as to run parallel to the longitudinal extent direction of the mouthpiece from the first outlet opening toward that end of the mouthpiece which lies opposite the main body in the operating position. This reservoir preferably does not indeed extend, however, as far as said end of the mouthpiece, but rather at most over 70% of the spacing between the first outlet opening and that end of the mouthpiece which lies opposite the main body in the operating position. This spacing is also preferably measured in the direction parallel to the longitudinal extent of the mouthpiece.

When setting down the mouthpiece after the drinking operation, an additional volume of the first liquid can be left in the mouth, specifically on the tongue, with the aid of the reservoir, as the result of which a pronounced aftertaste is perceived.

It can be provided in accordance with one preferred embodiment of the container head that the second outlet opening is configured at that end of the mouthpiece which lies opposite the main body in the operating position, wherein it is preferably provided that the second outlet opening extends both over a part of a lateral surface of the mouthpiece and over a part of an end surface of the mouthpiece which lies opposite the main body in the operating position.

In the case of a longitudinally elongate mouthpiece in the longitudinal extent direction, the surfaces which delimit the mouthpiece in the longitudinal extent direction are the end surfaces, whereas the remaining surfaces are the lateral surfaces. In one exemplary and simple case, the longitudinally elongate mouthpiece is a simple cylinder which has an upper and a lower end surface and a lateral surface. This cylinder can have a base or end surface which is circular, oval or else of a different shape. For example, it can also be, however, a cuboid which likewise has an upper and lower end surface, but has a quadrilateral lateral surface in contrast to a cylinder.

In other words, this means that the second outlet opening extends over an edge of that end of the mouthpiece which lies opposite the main body in the operating position, and is therefore arranged partially on one of the end surfaces of the mouthpiece and partially on the or on one of the lateral surfaces of the mouthpiece.

It can be provided in accordance with one preferred embodiment of the container head that the course of the first liquid line toward the first outlet opening is completely rectilinear and/or the course of the second liquid line toward the second outlet opening has at least one directional change.

It can be provided in accordance with one preferred embodiment of the container head that the container head has a metering apparatus with an actuator for adjusting a throughflow cross section in the first liquid line and/or in the second liquid line. As a result, the ratio of the quantity output per unit time of the first liquid to the quantity output per unit time of the second liquid can be set. The at least one actuator can be configured, for example, as a pivotable lever.

It can be provided in one preferred exemplary embodiment that the actuator can be adjusted into a first position, in which the first liquid and/or second liquid are/is blocked completely, and/or into a second, maximum open position, in which the first liquid or second liquid is dispensed from the mouthpiece. A very wide variety of intermediate positions are also possible. It can thus be set, for example, that the dispensed quantity of the first liquid or the second liquid corresponds to a third of the liquid quantity dispensed overall through the mouthpiece.

It can be provided in accordance with one preferred embodiment of the container head that the first liquid line is shorter than the second liquid line.

It can be provided in accordance with one preferred embodiment of the container head that the mouthpiece can be removed from the main body in a non-destructive manner and can be fastened to the main body in a non-destructive manner.

It can be provided in accordance with one preferred embodiment of the container head that at least one ventilating device for aerating and/or ventilating the first container and/or the second container are/is provided in the container head, preferably in the main body.

It can be provided in accordance with one preferred embodiment of the container head that the container head has a lid, wherein the lid closes the first outlet opening and the second outlet opening sealingly in a fastened state.

Furthermore, protection is sought for a drinking bottle, wherein the drinking bottle has a container head according to the invention and a first container and a second container, wherein the first container is connected to the first connector and the second container is connected to the second connector.

If the first container is connected via the first connector to the container head and the second container is connected via the second connector to the container head, it can be provided in one preferred embodiment that the first container is arranged within the second container. For example, embodiments are also conceivable, however, in which the containers which are fastened to the connectors of the container head are arranged next to one another. Drinking bottles according to the invention can of course also comprise more than two containers if the container head, as depicted above, has more than two connectors.

BRIEF DESCRIPTION OF THE DRAWINGS

Further advantages and details of preferred exemplary embodiments of the invention result from the figures and the associated description of the figures. In the figures.

DETAILED DESCRIPTION

Figure 1:
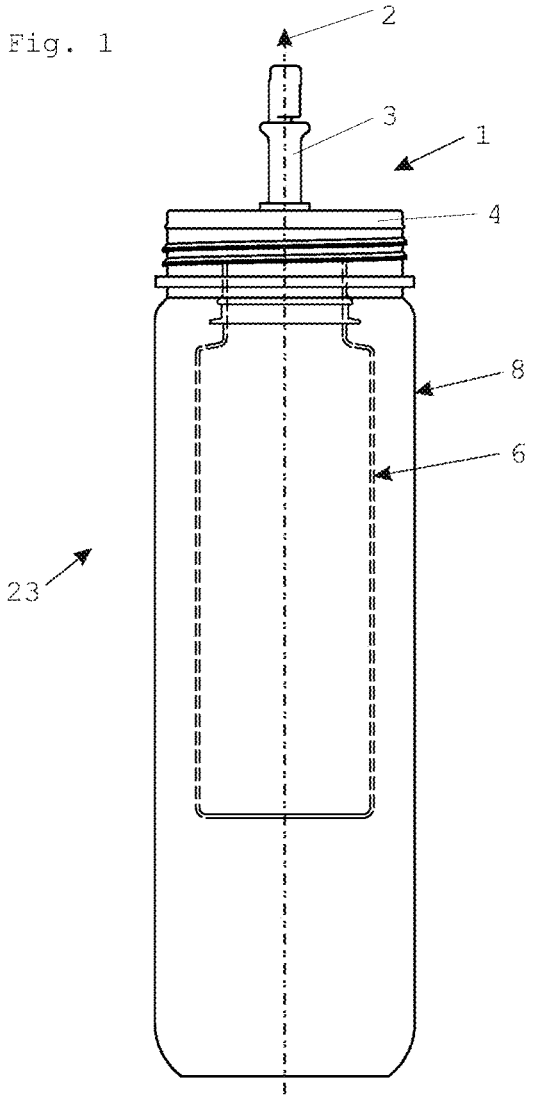
FIGS. 1 to 4 show one exemplary embodiment of a drinking bottle with a container head, a first container and a second container.

FIG. 1 shows one exemplary embodiment of a drinking bottle 23 with a container head 1, a first container 6 and a second container 8.

In this exemplary embodiment, the container head 1 has a main body 4 and a mouthpiece 3. The second container 8 is the outer container and can enclose the container 6 which is arranged in it. The first container 6 is shown by a dashed line in this illustration.

The containers 6 and 8 can be manufactured from a very wide variety of materials. The containers 6 and 8 can thus be produced, for example, from plastic, metal and/or composite material, can have different colors and/or can be of opaque or transparent configuration. They can also be provided with a smooth or rough and/or satin-finished surface.

In this exemplary embodiment, the longitudinal extent direction 2 of the container head 1 runs perpendicularly from the bottom to the top and coincides with the rotational axis of the container head 1. As a result of the substantially rotationally symmetrical configuration of the container head 1, the first container 6 and the second container 8, specifically the drinking bottle 23, the longitudinal extent direction 2 likewise coincides in this exemplary embodiment with a substantially rotationally symmetrical axis of the entire drinking bottle 23.

Figure 2:
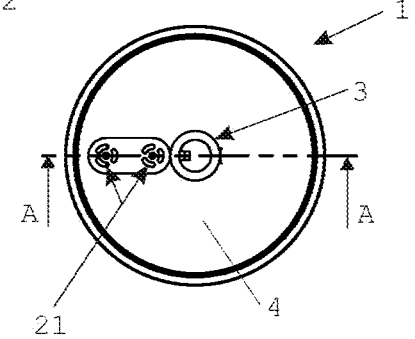

In FIGS. 1 and 2, the first container 6 is connected by means of the first connector 5 and the second container 8 is connected by means of the second connector 7 to the container head 1, to be precise in such a way that a first liquid in the first container 6 can flow via the first connector 5 into the first liquid line 9 and a second liquid in the second container 8 can flow via the second connector 7 into the second liquid line 11 when the drinking bottle 23 is tilted correspondingly during drinking.

FIG. 2 shows a plan view of the drinking bottle 23 from FIG. 1.

The plan view shows the container head 1 from above and therefore the main body 4 and the mouthpiece 3. In addition to the mouthpiece 3, two ventilating devices 21 for aerating and/or ventilating the containers 6 and 8 are situated in the main body 4.

In this exemplary embodiment, the ventilating devices 21 are two regions which are separate from one another and establish a fluidic connection between the surroundings and the interior of the first container 6 and the second container 8. The ventilating devices 21 can be permanently open openings. They can also have valves, however, which let air into the respective container 6 or 8, but prevent the outflow of liquid from the respective container 6 or 8. For this purpose, for example, silicone screen valves which are known per se might be integrated into one or all of the ventilating devices 21.

Figure 3:
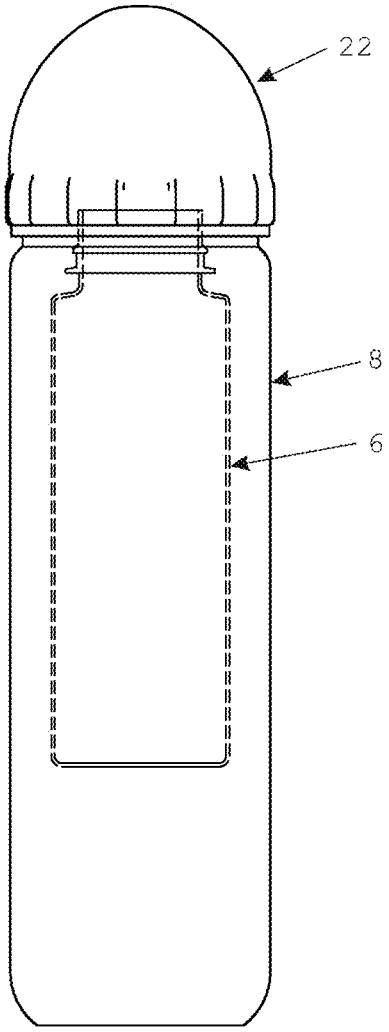

FIG. 3 shows the drinking bottle 23 from FIG. 1 with a lid 22.

In this illustration, this is the drinking bottle 23 from FIG. 1, wherein a lid 22 is attached to the second container 8. The lid 22 is connected here to the second container 8 by a screw connection, specifically a threaded connection. The lid might of course also be fastened directly to the container head 1, for example by means of a screw connection. Instead of a screw connection, other connection types such as, for example, a clamp connection can be used at this point.

Figure 4:
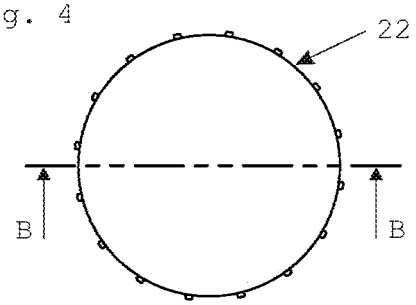

FIG. 4 shows a plan view of the drinking bottle 23 from FIG. 3.

Merely the lid 22 can be seen in this plan view. Projections are situated on the periphery of the lid 22, in order to facilitate screwing the lid 22 onto and unscrewing it from the container head 1.

Figure 5:
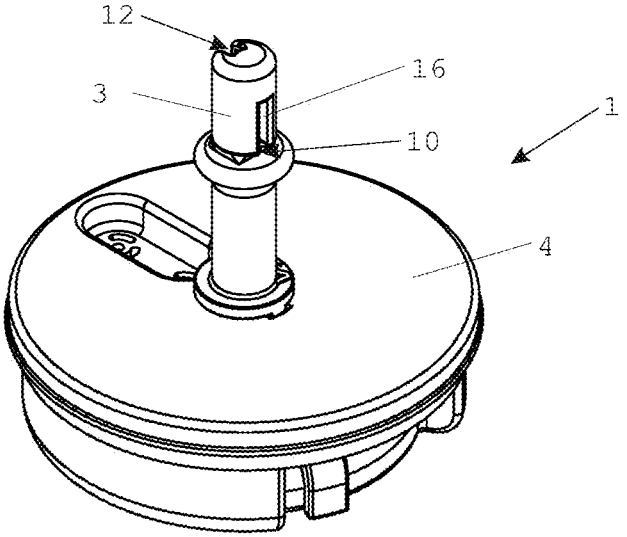
FIGS. 5 to 9 show illustrations with respect to the container head from FIGS. 1 to 4, and FIGS. 10 to 12 show illustrations with respect to the mouthpiece from FIGS. 1 to 9.

FIG. 5 shows a perspective view of the container head 1 from FIG. 1. As in FIG. 1, the mouthpiece 3 and the main body 4 can be seen in this illustration of the container head 1. One of the two ventilating devices 21 can likewise be seen, whereas the other of the two ventilating devices 21 is concealed by the perspective view.

In this exemplary embodiment, the mouthpiece 3 is a mouthpiece 3 which is longitudinally elongated in the longitudinal extent direction 2. As also realized in this exemplary embodiment, the mouthpiece 3 is preferably of substantially shank-shaped or pin-shaped configuration.

FIG. 5 shows the operating position, in which the mouthpiece 3 is fastened to the main body 4.

The mouthpiece 3 has a first outlet opening 10 and a second outlet opening 12. The first outlet opening 10 opens into a channel 15 and the reservoir 16.

Figure 6:
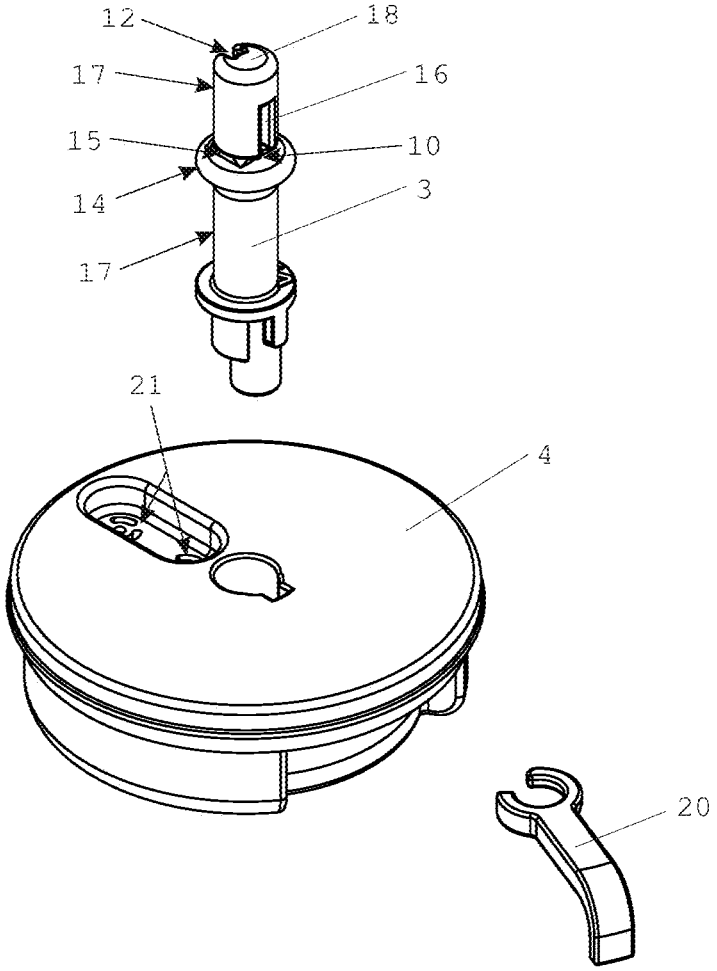

FIG. 6 shows an exploded view of the container head 1 from FIG. 1.

The mouthpiece 3, the main body 4 and the actuator 20 can be seen clearly and are separate from one another in this illustration.

In addition to the ventilating devices 21, the main body 4 comprises a centrally located hole, into which the mouthpiece 3 can be plugged. In this exemplary embodiment, the mouthpiece 3 and the main body 4 can therefore be connected to one another here via a plug-in connection. Screw connections and the like are also possible.

It can but does not necessarily have to be provided in another exemplary embodiment that the mouthpiece 3 and the main body 4 are connected to one another via another connection which can be released in a non-destructive manner. As in this example, a connection which can be released in a non-destructive manner can be a plug-in connection or clamp connection or else another connection such as, for example, a screw connection. The exemplary embodiments mentioned here of a connection between the mouthpiece 3 and the main body 4 are not to be understood as restrictive, since every desired connection between the mouthpiece 3 and the main body 4 is possible. The same also applies to the connection, which can preferably be released in a non-destructive manner, of the actuator 20 (configured here as a pivotable lever) to the main body 4.

In a region of its round peripheral surface, the main body 4 has a cutout, into which the actuator 20 can be introduced. The actuator 20 can be moved within the cutout of the peripheral surface of the main body 4, and is delimited in terms of its movement radius by the peripheral surface of the main body 4. In this exemplary embodiment, the actuator 20 is configured as a pivotable lever, by way of which the throughflow cross section in the second liquid line 11 can be set.

In addition to a first outlet opening 10 and a second outlet opening 12, the mouthpiece 3 has a bead 14 and a channel 15.

The first outlet opening 10 can be arranged exclusively in the region of the lateral surface 17 of the mouthpiece 3.

The first outlet opening 10 can be oriented in the longitudinal extent direction 2, as is realized in this exemplary embodiment and can be seen clearly in the following FIG. 7, or can be inclined at an angle with respect to the longitudinal extent direction 2.

In this exemplary embodiment, the first outlet opening 10 opens into the channel 15 and into the reservoir 16.

As is also shown in this exemplary embodiment, it can be provided that the first outlet opening 10 and the second outlet opening 12 are arranged on sides of the mouthpiece 3 which are different than one another and preferably lie opposite one another. That is to say, in other words, it is specifically the case here that the first outlet opening 10 and the second outlet opening 12 are arranged so as to lie opposite one another on the lateral surface 17 of the mouthpiece 3.

In this exemplary embodiment, the bead 14 is a rounded elevation which extends over the entire imaginary peripheral line of a cross-sectional plane of the mouthpiece 3, wherein the longitudinal extent direction 2 of the mouthpiece 3 lies perpendicularly on the cross-sectional plane.

In this exemplary embodiment, the bead 14 is directly adjacent with respect to the first outlet opening 10.

It can be provided in another exemplary embodiment that the bead 14 is spaced apart from the first outlet opening 10 at a spacing, preferably measured parallel to the longitudinal extent direction 2 of the mouthpiece 3, of at most three times, preferably at most two times, particularly preferably at most one time, the height of the bead 14.

The bead 14 in any case prevents the first outlet opening 10 and preferably also the channel 15 from being closed by the tongue of the drinker. Moreover, it serves as a positioning aid in the mouth of the drinker.

The channel 15 is an outwardly open channel which extends over a large part of the periphery of a cross-sectional plane of the mouthpiece 3, wherein the longitudinal extent direction 2 of the mouthpiece 3 lies perpendicularly on this cross-sectional plane. It can be provided in another exemplary embodiment that the channel 15 extends only over a smaller region of the periphery of the mouthpiece 3.

As provided in this exemplary embodiment, the channel 15 can be arranged directly adjacently with respect to the bead 14. In another design variant, the bead 14 and the channel 15 can be separated from one another by a spacing which is measured in the longitudinal extent direction 2.

Figure 7:
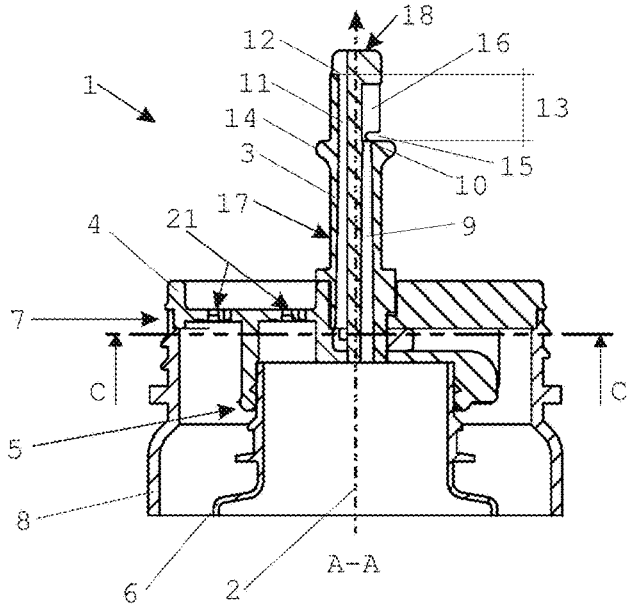

FIG. 7 shows a sectional illustration of the container head 1 from FIG. 1 in the sectional plane A-A from FIG. 2.

It can be seen clearly in FIG. 7 that the first container 6 is connected by the first connector 5 to the container head 1, and the second container 8 is connected by the second connector 7 to the container head 1. It can be seen, moreover, that the interior of the containers 6 and 8 is connected in each case via the ventilating devices 21 to the surroundings, in order to make pressure equalization or an inflow of air during drinking possible. When the containers 6 and 8 are connected to the connectors 5 and 7, air which is displaced from the containers 6 and 8 can also flow out correspondingly via the ventilating devices 21. The ventilating devices 21 can therefore be used both for aerating and for ventilating.

The mouthpiece 3 comprises a first liquid line 9 which runs from the first connector 5 and therefore from the first container 6 as far as the first outlet opening 10 in the interior of the mouthpiece 3, and a second liquid line 11 which runs from the second connector 7 and therefore from the second container 8 in the interior of the mouthpiece 3 as far as the second outlet opening 12.

The first outlet opening 10 opens into the outwardly open channel 15 in the mouthpiece, wherein the channel 15 runs at least partially along a periphery of the mouthpiece 3.

Apart from this, the first outlet opening 10 can instead or in addition, as also realized in this exemplary embodiment, open into a longitudinally elongate reservoir 16 which is configured as an outwardly open groove in the mouthpiece 3, wherein it is preferably provided that the reservoir 16 is arranged so as to run parallel to the longitudinal extent direction 2 of the mouthpiece 3 from the first outlet opening 10 toward that end of the mouthpiece 3 which lies opposite the main body 4 in the operating position.

In this exemplary embodiment, the spacing 13 between the first outlet opening 10 and the second outlet opening 12, as measured in the longitudinal extent direction 2, is at least 3 mm, preferably at least 5 mm, particularly preferably at least 8 mm. The spacing 13 preferably lies, however, in a range up to at most 20 mm.

It can be provided in one preferred design variant that the second outlet opening 12 is configured at that end of the mouthpiece 3 which lies opposite the main body 4 in the operating position, wherein it is preferably provided that the second outlet opening 12 extends both over a part of a lateral surface 17 of the mouthpiece 3 and over a part of an end surface 18, lying opposite the main body 4 in the operating position, of the mouthpiece. This is also realized in this exemplary embodiment in the same way as FIG. 7 also shows.

In this preferred exemplary embodiment, moreover, it can be seen clearly in FIG. 7 that the course of the first liquid line 9 toward the first outlet opening 10 is completely rectilinear, and the course of the second liquid line 11 toward the second outlet opening 12 has at least one directional change. In this regard, however, different solutions are of course also possible within the context of the invention.

In this way, the result is that the first liquid line 9 is shorter than the second liquid line 11.

Figure 8:
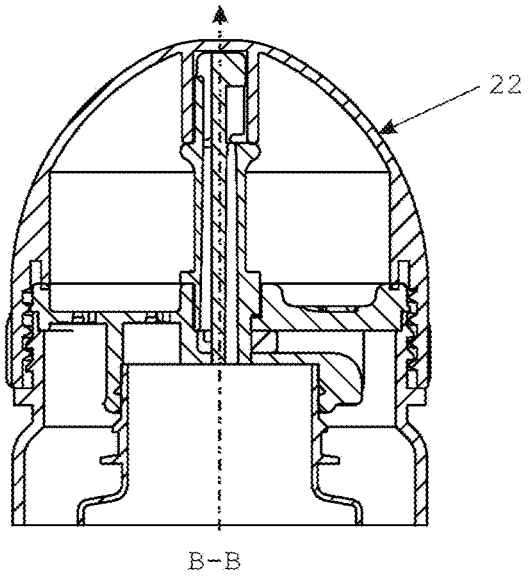

FIG. 8 shows a sectional illustration of the container head 1 and the lid 22 from FIG. 3 in the sectional plane B-B from FIG. 4.

It can be seen clearly in this illustration that the lid 22 is fastened via a fastening means to the drinking bottle 23, specifically to the second container 8. In this exemplary embodiment, this fastening means comprises an external thread of the second container 8 and an internal thread of the lid 22. The lid 22 might also be capable of being fastened directly to the container head 1 in other design variants, however.

As is also realized here, the lid 22 can close the first outlet opening 10 and the second outlet opening 12 sealingly in a state in which it is fastened to the container head 1.

Figure 9:
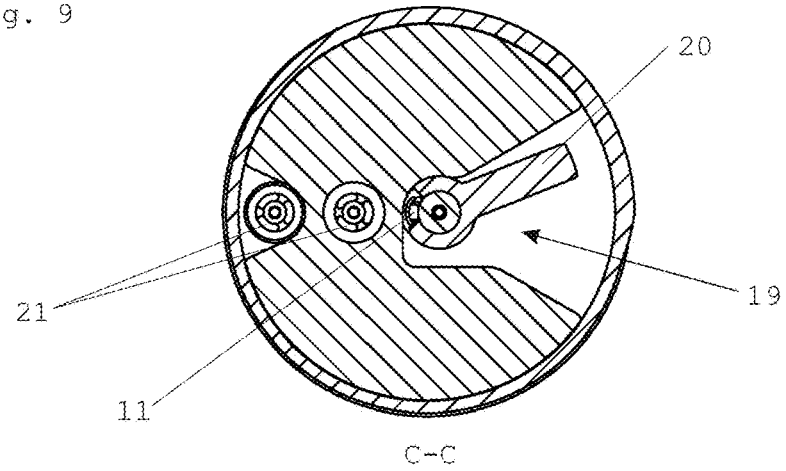

FIG. 9 shows a sectional illustration of the container head 1 from FIG. 1 using the sectional plane C-C from FIG. 7.

The metering apparatus 19 can be seen clearly in this illustration. It has an actuator 20, by way of which are throughflow cross section of the second liquid line 11 can be adjusted. In this exemplary embodiment, the actuator 20 is a pivotable lever, the pivot point of which is situated on the main body 4. In the illustrated position of the actuator 20, the liquid line 11 is open. If the actuator 20 is moved into the opposite position, the liquid line 11 is increasingly closed and therefore the throughflow cross section is reduced.

The setting of the actuator 20 can take place in a stepped or infinitely variable manner. By way of a throughflow cross section being set in the second liquid line 11, the throughflow quantity of the second liquid and therefore ultimately the consumption ratio or the quantity ratio of the first liquid with respect to the second liquid can therefore be set.

In another exemplary embodiment, it can be provided instead or in addition that another and/or the same metering apparatus controls the volumetric flow, in other words the throughflow cross section, of the first liquid line 9 and therefore the throughflow quantity of the first liquid.

Figure 10:
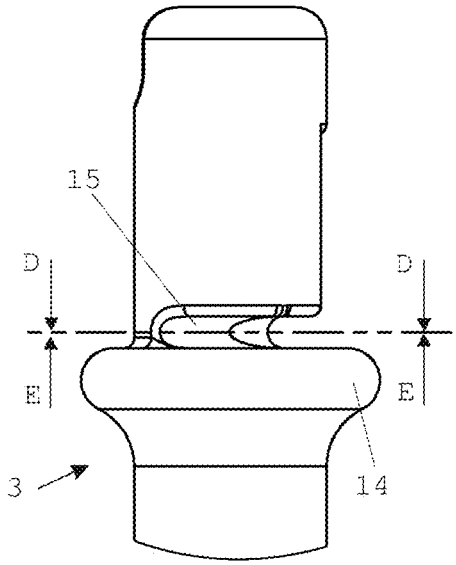

FIG. 10 shows a detailed view of the mouthpiece 3 from FIG. 1. The bead 14 and the channel 15 can be seen clearly.

Figure 11:
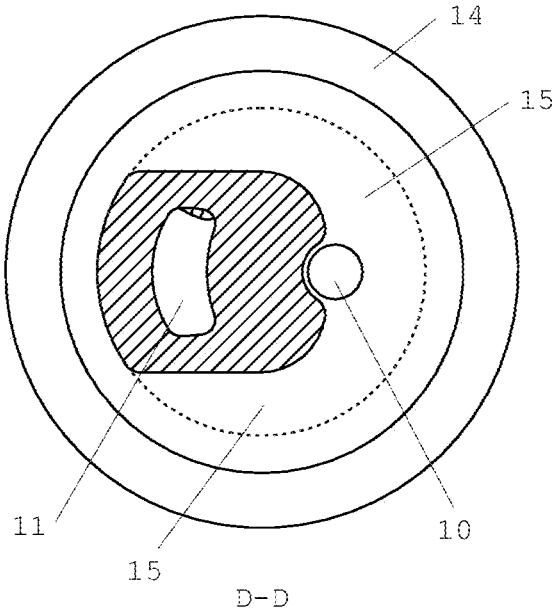

FIG. 11 shows a sectional illustration of the mouthpiece 3 from FIG. 1 in the sectional plane D-D from FIG. 10. This illustration shows the cross section of the mouthpiece 3 along the sectional plane D-D in a manner which points in the viewing direction toward the main body 4.

The bead 14 and the outwardly open channel 15 are concentric with the rotationally symmetrical axis of the mouthpiece 3. The first outlet opening 10 and the second liquid line 11 are not concentric with the rotationally symmetrical axis of the mouthpiece 3.

The second liquid line 11 has a throughflow cross section which, in this exemplary embodiment, corresponds substantially to the shape of a circular ring portion. The first outlet opening 10 which has a circular cross section in this exemplary embodiment is arranged adjacently at a certain distance.

The channel 15 is delimited toward the inside by the hatched region. Toward the outside, the outwardly open channel 15 is delimited by an imaginary peripheral line which is shown as a dashed line in FIG. 11 and corresponds to the peripheral contour of that end of the mouthpiece which lies opposite the main body 4 in the operating position.

Figure 12:
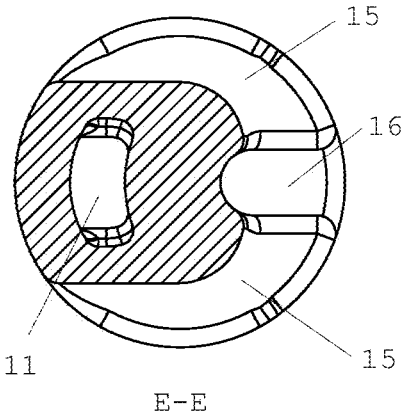

FIG. 12 shows a sectional illustration of the mouthpiece 3 from FIG. 1 in the sectional plane E-E from FIG. 10.

This illustration shows the cross section of the mouthpiece 3 along the sectional plane D-D in the viewing direction pointing away from the main body 4.

The second liquid line 11 and the reservoir 16 are not concentric with the rotationally symmetrical axis of the mouthpiece 3. The second liquid line 11 is situated in the hatched region and has the same shape as described in FIG. 11.

The outlet opening 10 opens both into the channel 15 and into the reservoir 16. The reservoir 16 is an outwardly open groove, which can be seen clearly in FIG. 12. The channel 15 is delimited toward the outside by the peripheral contour of the mouthpiece 3.

LIST OF DESIGNATIONS

1 Container head
2 Longitudinal extent direction
3 Mouthpiece
4 Main body
5 First connector
6 First container
7 Second connector
8 Second container

9 First liquid line
10 First outlet opening
11 Second liquid line
12 Second outlet opening
13 Spacing
14 Bead
15 Channel
16 Reservoir
17 Lateral surface
18 End surface
19 Metering apparatus
20 Actuator
21 Ventilating device
22 Lid
23 Drinking bottle

The invention claimed is:

1. A container head (1), comprising:

a mouthpiece, longitudinally elongate in a longitudinal extent direction;

a main body having a first connector for a first container for receiving a first drinkable liquid and a second connector for a second container for receiving a second drinkable liquid, and the mouthpiece is fastened in the main body in an operating position;

a first liquid line for transporting the first drinkable liquid in the operating position leads from the first connector through an interior of the mouthpiece to a first outlet opening in the mouthpiece;

a second liquid line for transporting the second drinkable liquid in the operating position leads from the second connector through the interior of the mouthpiece to a second outlet opening in the mouthpiece; and the first outlet opening is arranged further away from an end of the mouthpiece which lies opposite the main body in the operating position than the second outlet opening.

2. The container head as claimed in claim 1, wherein a spacing between the first outlet opening and the second outlet opening is at least 3 mm.

3. The container head as claimed in claim 1, wherein the first outlet opening and the second outlet opening are arranged on sides of the mouthpiece which are different than one another.

4. The container head as claimed in claim 1, wherein the mouthpiece has a bead, the bead is arranged directly adjacently with respect to the first outlet opening, or is spaced apart from the first outlet opening by a spacing of at most three times a height of the bead.

5. The container head as claimed in claim 4, wherein the bead runs along a peripheral line of the mouthpiece, the peripheral line of the mouthpiece lies in one plane, and the longitudinal extent direction of the mouthpiece lies perpendicularly to the one plane.

6. The container head as claimed in claim 1, wherein the first outlet opening opens into an outwardly open channel in the mouthpiece, and the channel runs at least partially along a periphery of the mouthpiece.

7. The container head as claimed in claim 1, wherein the first outlet opening extends into a longitudinally elongate reservoir which is configured as an outwardly open groove in the mouthpiece.

8. The container head as claimed in claim 7, wherein the reservoir is arranged to extend parallel to the longitudinal extent direction of the mouthpiece from the first outlet opening toward an end of the mouthpiece which lies opposite the main body in the operating position.

9. The container head as claimed in claim 1, wherein the second outlet opening is configured at the end of the mouthpiece which lies opposite the main body in the operating position.

10. The container head as claimed in claim 9, wherein the second outlet opening extends both over a part of a lateral surface of the mouthpiece and over a part of the end surface of the mouthpiece which lies opposite the main body in the operating position.

11. The container head as claimed in claim 1, wherein the course of the first liquid line toward the first outlet opening is completely rectilinear.

12. The container head as claimed in claim 1, further comprising a metering apparatus with an actuator for adjusting a throughflow cross section in at least one of the first liquid line or the second liquid line.

13. The container head as claimed in claim 1, wherein the first liquid line is shorter than the second liquid line.

14. The container head as claimed in claim 1, wherein the mouthpiece is non-destructively removable from the main body and is non-destructively fastenable to the main body.

15. The container head as claimed in claim 1, further comprising at least one ventilating device for aerating and/or ventilating at least one of the first container or the second container (8).

16. The container head as claimed in claim 15, wherein the at least one ventilating device is in the main body.

17. The container head as claimed in claim 1, further comprising a lid that closes the first outlet opening and the second outlet opening sealingly in a fastened state.

18. A drinking bottle, comprising:

the container head as claimed in claim 1;

the first container; and the second container;

wherein the first container is connected to the first connector and the second container is connected to the second connector.

19. The container head as claimed in claim 1, wherein the course of the second liquid line toward the second outlet opening has at least one directional change.

* * * * *